United States Patent [19]

Horton

[11] 4,176,520

[45] Dec. 4, 1979

[54] DRIVE SYSTEM FOR DEEP WELL PUMP

[76] Inventor: James B. Horton, P.O. Box 1758, Kilgore, Tex. 75662

[21] Appl. No.: 881,757

[22] Filed: Feb. 27, 1978

[51] Int. Cl.[2] ..... F15B 11/15

[52] U.S. Cl. ..... 60/369; 60/384; 60/537; 91/303

[58] Field of Search ..... 60/369, 371, 372, 378, 60/379, 384, 537, 544, 579, 593; 91/4, 281, 303

[56] References Cited

U.S. PATENT DOCUMENTS

| | | | |
|---|---|---|---|
| 245,101 | 8/1881 | Thayer et al. . | |
| 706,688 | 8/1902 | Reynders et al. | 91/4 X |
| 852,061 | 4/1907 | Hoffman . | |
| 1,136,946 | 4/1915 | Erb . | |
| 1,242,548 | 10/1917 | Harris | 417/46 |
| 2,131,910 | 10/1938 | Vernon et al. | 60/378 X |
| 2,261,752 | 11/1941 | Buckner . | |
| 2,809,596 | 10/1957 | Sullwold et al. | 60/478 X |
| 3,369,490 | 2/1968 | Hawk | 60/372 X |
| 3,761,204 | 9/1973 | Pauliukonis | 417/401 |
| 4,026,661 | 1/1976 | Roeder | 417/53 |

*Primary Examiner*—Edgar W. Geoghegan
*Attorney, Agent, or Firm*—Richards, Harris & Medlock

[57] ABSTRACT

A drive system is provided for driving the pump rod of a deep well pump. The drive system includes a lift cylinder having a piston movable therein connected to the pump rod of the well pump. The lift cylinder piston is driven by fluid pressure provided from a motor having a piston slidable within a cylinder. The motor piston is driven by fluid pressure provided by a pump. A control valve is operated in response to the movement of the lift piston to control the flow of fluid from the pump to the motor. A pressure relief valve is connected between the pump and the motor and diverts fluid pumped by the pump from the motor when the fluid pressure between the pump and the motor exceeds a predetermined level. A vent is provided in the lift cylinder above the piston to permit the free movement of the lift cylinder piston during operation and to accommodate movement of the lift piston caused by expansion of fluid and gases in the system. The drive system further includes a fluid control valve for controlling the rate of fluid flow from the motor to the lift cylinder. In another embodiment of the invention, the motor piston is driven by a power unit which reciprocates the motor piston to direct fluid to the lift cylinder for operation of the lift piston.

1 Claim, 9 Drawing Figures

DRIVE SYSTEM FOR DEEP WELL PUMP

FIELD OF THE INVENTION

The present invention relates to a deep well pump drive system, and more particularly to a hydraulic drive system for driving the pump rod of a deep well pump.

BACKGROUND OF THE INVENTION

Prior Art

Pump systems for removing subsurface fluids, such as oil or water, normally include a pump assembly which is reciprocated in a working barrel through which the oil or water is drawn upwardly to the top of the wellhead. The pump assembly is normally driven by a drive unit which reciprocates the pump assembly through a pump or sucker rod. The pump rod is attached between the drive unit located at or near the wellhead and to the pump assembly located below the wellhead.

Because of the possibility that the pump assembly may become stalled in the working barrel, it is necessary to provide a system which will drive the pump rod under normal load conditions but which will cease operation is the event the downhole pump assembly is stalled. Such an arrangement prevents damage to the downhole structure as well as the drive unit used to drive the pump assembly.

While fluid pressure has been used to drive a motor which in turn drives the pump rod, past systems have not adequately provided for the situation where the pump piston is stalled in the downhole line. Further, past drive systems have failed to provide adequate control on the rate of operation of the downhole pump or the pump stroke. The pump drive system must also provide for expansion of gases and fluids within the system as a result of variation in ambient temperatures. Systems now in use fail to compensate for such expansions in a way compatible with the operation of the drive unit. Further, presently used units are of a size generally requiring the construction of considerable foundations on which they are supported.

SUMMARY OF THE INVENTION

The present invention provides a hydraulic drive system for driving the pump rod of a deep well pump which overcomes the deficiencies heretofore found in systems of this type. The drive system of the present invention includes a motor having a piston slidable within a cylinder. The piston divides the motor cylinder into a first and second chamber both of which are normally filled with hydraulic fluid. A pump is provided for pumping fluid from a reservoir into the first chamber of the motor. As fluid is pumped into the first chamber, the piston is driven in the cylinder and forces hydraulic fluid from the second chamber. A valve is provided between the motor and the pump for controlling the flow of fluid from the pump to the motor.

The drive system further includes a lift cylinder having a piston movable therein. The piston is connected to the pump rod of the well pump. The second chamber of the motor is in fluid communication with the lift cylinder so that fluid is directed from the second chamber to the lift cylinder as the motor piston is moved in the motor cylinder. In this way, the lift cylinder is driven as the motor piston moves under the action of fluid being pumped therein.

Control structure is operated by the movement of the pump rod and operates a valve in response to the operation of the lift piston. In one embodiment of the invention, this control structure is engaged by the pump rod and positions the valve in a first position wherein the flow of fluid from the pump to the motor is stopped when the lift piston reaches a predetermined upper stroke position. Similarly, the valve is moved to a second position by the pump rod control structure wherein fluid is communicated from the pump to the motor when the lift piston reaches a predetermined lower stroke position.

Thus, as the lift piston reaches a lower stroke position, fluid is communicated from the pump to the motor which in turn forces fluid into the lift cylinder causing the lift piston to rise and draw the pump rod upwardly with it. As the lift piston reaches a predetermined upper stroke position, fluid communication between the pump and the motor is cut off and the lift piston falls under the action of gravity thereby driving the pump rod downwardly. This procedure continues cyclically to reciprocate the pump rod attached to the pump system in the downhole line. As a result of this action, fluid in the well is pumped to the wellhead where it is carried away.

In accordance with another embodiment of the invention, a pressure relief valve is connected between the pump and the motor and diverts fluid pumped by the pump from the motor when the fluid pressure between the pump and the motor reaches a predetermined level. Thus, when for any reason the normal operating pressure of the fluid directed from the pump to the lift cylinder fails to raise the lift piston, excessive pressure is vented through a pressure relief valve rather than being transmitted to the lift piston and the pump rod. In this way, loading on the lift piston and pump rod and, therefore all the structure in all the pumping structure in the downhole line, may be very accurately controlled so as not to exceed a predetermined level. In one embodiment of the invention, this pressure relief system directs fluid back into the pump reservoir for later use.

In accordance with still another embodiment of the invention, a second valve is provided in the lift cylinder above the piston. This valve is normally open to the atmosphere and permits the free rising of the lift cylinder piston as the piston is driven upwardly to operate the pump rod. Further, on the lift piston downstroke, air is drawn in above the piston to permit the free fall of the lift piston to complete the cycle.

More importantly, this valve permits the lift piston to rise to compensate for expansion of fluid and gases in the system resulting from changes in temperature. Extreme pressures can be built up into the pumping system due to the heating of the fluid as when the unit is exposed to temperature variations in the summer sun. By providing for the relief valve in the lift cylinder, the lift piston may rise as necessary to compensate for expansion due to changing temperatures. Thus, the present arrangement avoids the extreme internal pressures which could occur and likewise eliminates the possibility of damage resulting to packings or other seals which would otherwise occur.

In accordance with still another embodiment of the present invention, the drive system further includes a fluid control valve for controlling the rate of fluid flow from the motor to the lift cylinder. By controlling the rate of fluid flow, the pump rate of the lift cylinder may be varied as desired.

In accordance with still another embodiment of the invention, a drive system for driving the pump rod of a deep well includes a lift cylinder having a piston movable therein. The piston is connected to the pump rod of the well pump. A motor is provided having a piston slidable within a cylinder. The motor piston divides the cylinder with a chamber above and a chamber below the piston. One chamber of the cylinder is in fluid communication with the chamber of the lift cylinder at a point below the lift cylinder piston. A power unit is provided for reciprocating the motor piston to direct fluid from one chamber of the motor to the lift cylinder to raise the lift cylinder piston. As fluid is directed beneath the lift piston, the piston and pump rod of the well are raised. A pressure relief valve is provided between the motor and the lift cylinder for directing fluid pumped by the motor from the lift cylinder when the fluid pressure between the motor and the cylinder reaches a predetermined level. Thus, if the downhole line pump system becomes stalled, this pressure relief valve operates to prevent overloading the lift cylinder and pump rod.

In accordance with this embodiment of the invention, the system is further provided with a valve in the lift cylinder above the piston, the valve being open to the atmosphere to permit free rising of the lift cylinder piston as necessitated by operation of the unit or expansion of the fluids resulting from temperature variations.

A fluid control valve is positioned between the motor and the lift piston for controlling the rate of fluid flow from the motor to the lift cylinder. Additionally, reciprocation of the motor piston is controlled to vary the stroke of the lift piston and thus the operation of the pump rod and downhole pump system. .

DESCRIPTION OF THE DRAWINGS

For a more complete understanding of the present invention, and for further details and advantages thereof, reference is now made to the following description taken in conjunction with the accompanying drawings in which.

DESCRIPTION OF THE PREFERRED EMBODIMENTS

Figure 1:
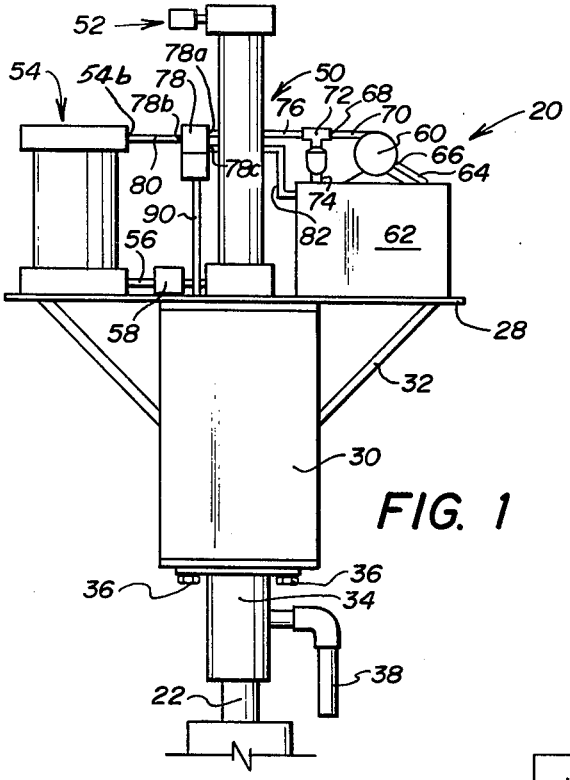
FIG. 1 is a side elevational view of the hydraulic drive system of the present invention mounted on a wellhead.

FIG. 1 is a side elevation view of a hydraulic drive system 20 embodying the present invention mounted on the outer casing 22 of a deep well pump. The drive system 20 includes a platform 28 rigidly attached to and supported above a housing 30 by platform supports 32. Housing 30 is rigidly attached to a wellhead housing unit 34 by appropriate fasteners such as bolts 36. Wellhead housing unit 34 is threadedly engaged onto the upper end of outer casing 22 and is also provided with a discharge pipe 38 through which fluid drawn from the ground through outer casing 22 is discharged.

Platform 28 supports a lift cylinder unit 50 which has a vent valve 52 attached near the top thereof. A motor 54 is in fluid communication with lift cylinder unit 50 through conduit 56. A fluid volume control valve 58 is mounted between motor 54 and lift cylinder unit 50 in conduit 56. A fluid pump 60 is connected to a fluid reservoir 62 at its input inlet 66 by conduit 64. The output inlet 68 of pump 60 is connected by conduit 70 to a pressure relief valve 72. A conduit 74 connects a second port of pressure relief valve 72 to reservoir 62. A conduit 76 connects a third port of pressure relief valve 72 to port 78*a* of a fluid directional control valve 78. A conduit 80 connects a port 78*b* of control valve 78 to port 54*b* of motor 54. A conduit 82 connects port 78*c* of control valve 78 to reservoir 62. A valve rod 90 extends from control valve 78 into housing 30.

Figure 2:
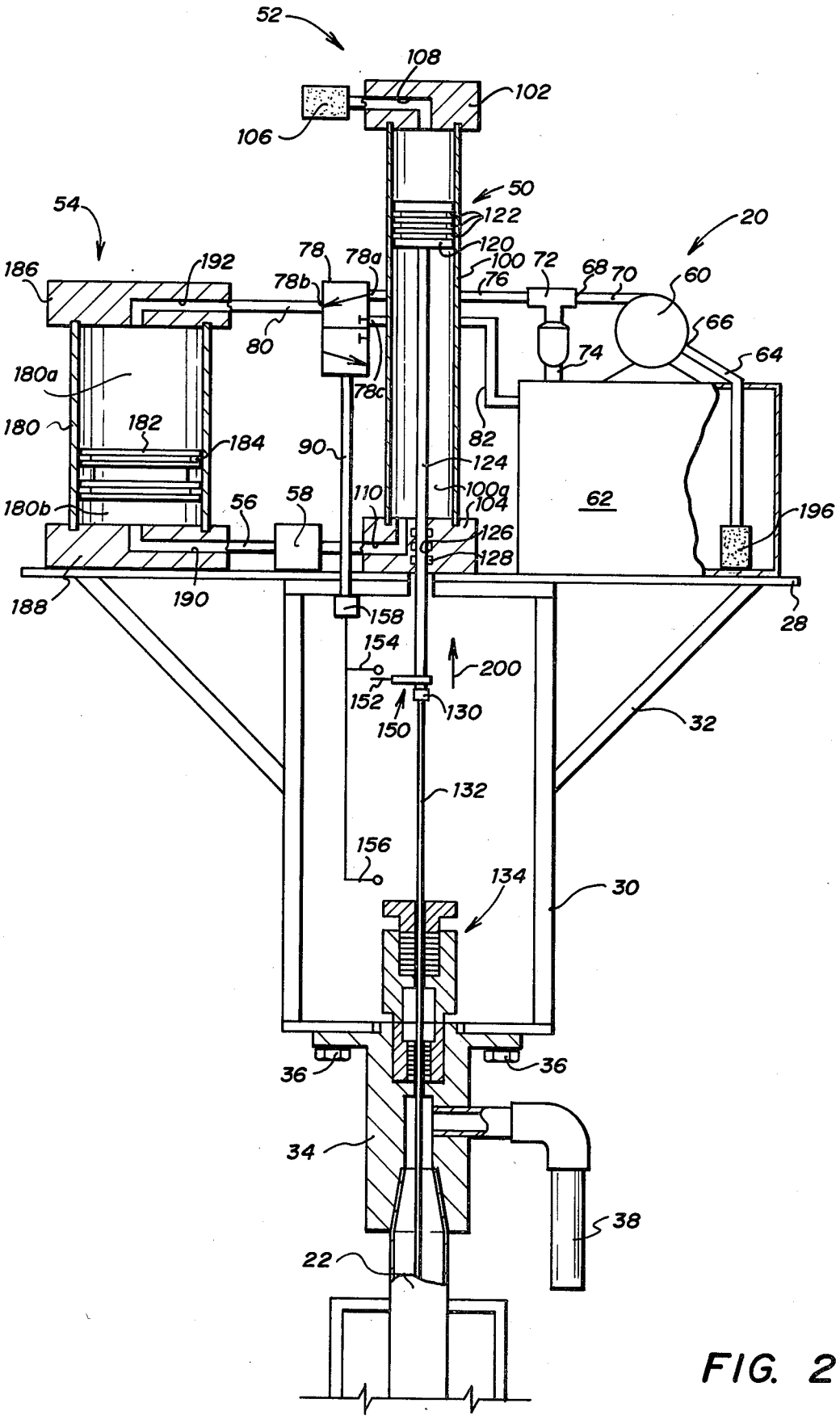
FIG. 2 is a partially diagrammatic vertical section view of the drive system illustrated in FIG. 1.

Referring to FIG. 2, a vertical section of hydraulic drive system 20 is shown partially in schematic. Lift cylinder unit 50 includes a cylinder 100 having an upper manifold 102 and a lower manifold 104 closing the upper and lower ends, respectively. Valve vent 52 includes an air filter unit 106 attached to a port 108 which communicates through manifold 102 into cylinder 100. Manifold 104 likewise includes a port 110 communicating between the interior of lift cylinder 100 and conduit 56. Lift cylinder 100 is fitted with a lift piston 120 which is fitted with three sealing rings 122 around the circumference thereof. Piston 120 and rings 122 are sized such that rings 122 engage the side wall of cylinder 100 as piston 120 reciprocates within the cylinder. A piston rod 124 is attached to the lower face of piston 120 and passes through an aperture 126 in manifold 104. Aperture 126 is also fitted with three circular seals 128 which form a fluid tight seal between the manifold and the piston rod.

A coupling 130 at the lower end of rod 124 connects the piston rod to a polish rod 132. Polish rod 132 passes through a stuffing box 134 and into the well casing 22 where the rod is connected to and actuates the well pump unit. Stuffing box 134 is threadedly engaged within wellhead housing 34 and provides sufficient sealing and packing components to provide a fluid tight seal between the wellhead housing and polish rod. A switching actuator arm 150 is attached to and extends from piston rod 124. The outer end portion 152 of arm 150 extends radially outwardly from rod 124 and is aligned between an upper valve switch arm 154 and a lower valve switch arm 156 attached to valve rod 90. Valve rod 90 extends from fluid directional control valve 78 through platform 28 and is supported relative to the frame by a guide housing 158. Housing 158 prevents side to side movement of valve rod 90 relative to platform 28, but includes appropriate bushing (not shown) to prevent free vertical movement of rod 90 for the purposes to be hereinafter discussed in greater detail.

Motor 54 includes a cylinder 180 with a piston 182 movable therein. Piston 182 is fit with appropriate sealing rings 184 around the circumference thereof to form a fluid tight seal between the piston 182 and cylinder 180. The upper and lower ends of cylinder 180 are closed by manifolds 186 and 188, respectively. Manifold 188 is formed with a port 190 therethrough which communicates between the interior of cylinder 180 and conduit 56. Manifold 186 likewise includes a port 192 therethrough which communicates between the interior of cylinder 180 and conduit 80.

Figure 3:
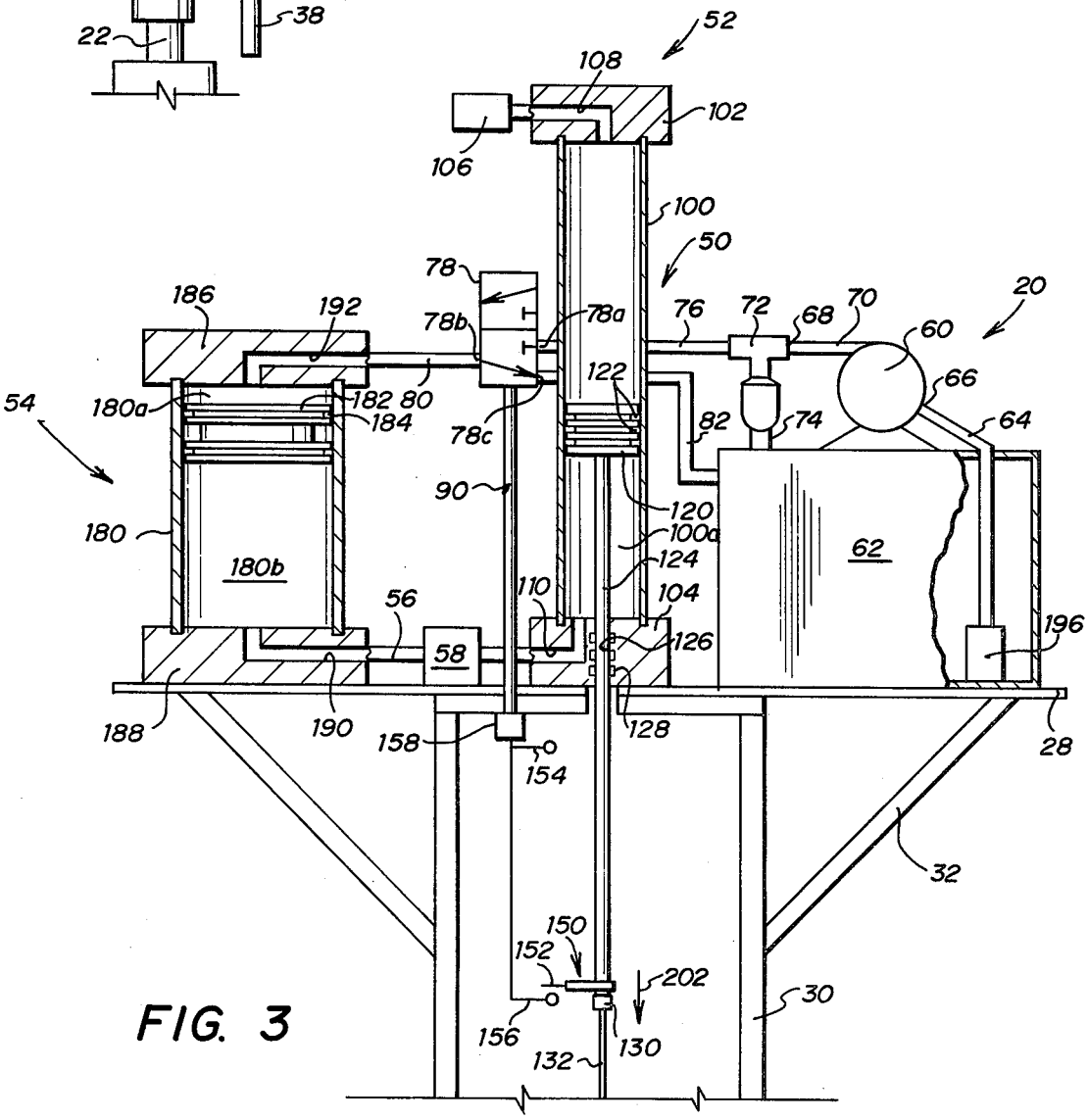
FIG. 3 shows the drive system as illustrated in FIG. 2, but with the lift piston near the lowermost point of its stroke.

Fluid directional control valve 78 is a two position, two connection valve shown in schematic view in FIGS. 2 and 3. When valve 78 is in the position illustrated in FIG. 2, there is fluid communication between conduits 76 and 80 with flow from conduit 82 past valve 78 being blocked. When valve 78 is in the position illustrated in FIG. 3, fluid communication is provided between conduits 80 and 82 and passage of fluid from conduit 76 through valve 78 is blocked.

Fluid volume control valve 58 may be of any valve structure design which permits continuous and selective variation of the volume of fluid permitted therethrough. In one preferred embodiment of the invention, a pressure compensated flow control valve is provided for use in the system. The pressure compensation provides a uniform flow regardless of the input pressure generated from motor 54.

The operation of the hydraulic drive system 20 illustrated in FIGS. 1 through 3 is best described by referring to FIGS. 2 and 3. FIG. 2 illustrates the point in the cycle operation of the system wherein piston 182 is near the uppermost point of its stroke in cylinder 180. Piston 120 is approaching the bottom of its stroke in cylinder 100. Fluid directional control valve 78 is in the position in which fluid communication is provided between conduits 76 and 80. The system is loaded with appropriate hydraulic fluid by filling the area within cylinder 180 below piston 182 as well as the area below piston 120 and cylinder 100 with hydraulic fluid. Likewise, the communicating conduit 56 is filled with hydraulic fluid.

At this point in the operation of the drive system of the present invention, pump 60 is activated to draw fluid from reservoir 62 through a filter unit 196 and direct is through conduit 70 and pressure relief valve 72 and into conduit 76. Valve 78 being in the position illustrated in FIG. 2 permits the passage of fluid from conduit 76 into conduit 80 and into chamber 180*a* above piston 182. The introduction of fluid into upper chamber 180*a* causes the downward movement of piston 182 and the expulsion of fluid from lower chamber 180*b* below piston 182 through conduit 56 and fluid volume control valve 58 into lower chamber 100*a* below piston 120 of lift cylinder 100. As a result, the entry of fluid below piston 120 will cause the piston to rise in cylinder 100. As piston 120 rises, polish rod 132 also rises as indicated by arrow 200, thus operating the pump piston in the downhole portion of the well. Rod 124 also moves upwardly with piston 120, and arm 150 connected to rod 124 follows the upward movement of piston 120. Near the upper end of the stroke of piston 120, the outer end portion 152 of arm 150 engages upper valve switch arm 154 which in turn moves valve 78 to the position shown in FIG. 3.

As valve 78 is switched to the position illustrated in FIG. 3, fluid communication between conduit 76 and conduit 80 is cut off and fluid communication between conduit 80 and return conduit 82 is made. With no fluid pressure acting above piston 182, the piston will cease its downward motion. Piston 120 of lift cylinder unit 50 will move downwardly as indicated by arrow 202 under the action of gravity and force fluid through conduit 56 and into lower chamber 180*b* causing piston 182 to rise and fluid in upper chamber 180*a* to flow through valve 78 back into reservoir 62 as piston 120 falls, and approaches the bottom of its stroke in cylinder 100. End portion 152 of arm 150 will engage lower valve switch arm 156 and through valve rod 90 will again switch valve 78 to the position illustrated in FIG. 2. At this point, the cycle will repeat itself, causing piston 120 to reciprocate within cylinder 100 and likewise causing the reciprocation of polish rod 132 to drive the well pump attached thereto.

Referring to FIGS. 2 and 3, it can be seen that motor 54 has a substantially larger diameter than lift cylinder unit 50. Thus, motor piston 182 will operate through a relatively short stroke to produce a high pressure fluid for the actuation of lift piston 120. The lift piston will operate through a much longer stroke. This arrangement has been found to be advantageous in that less horsepower is required resulting in an improved economy for the overall system.

In the event the well pump is stalled in the downhole line, such that piston 120 cannot be raised under the normal action of fluid pressure generated from pump 60, the present system provides a fail-safe arrangement to stop the operation of the lift cylinder thereby preventing damage to the downhole pump or gears in the pumping system. In the event of such a stall in the downhole pumping unit, pressure buildup will occur within the line between pump 60 and upper chamber 180*a*. As this pressure increases beyond a predetermined level, pressure relief valve 72 will open to permit the flow of fluid through conduit 74 back into reservoir 62. In this way, the forces exerted by the fluid pressure on each of the components in the system used to drive lift cylinder piston 120 can be accurately limited to a predetermined level so that none of the components in the system will be overloaded.

Vent valve 52 also plays an important part in the operation of the present invention. As piston 120 rises in cylinder 100, air above the piston is freely vented through filter 106. Also, as piston 120 falls within cylinder 100, air is freely drawn into the area above the piston, thus providing no resistance to the free fall of the piston. Moreover, when the unit is not in operation, piston 120 is free to rise under the expansion of the fluid or gases contained therebelow. This feature is extremely important in that the expansion of fluids resulting from changes in temperature can be extremely large, and without the relief feature of the present invention, damage can be sustained to the packings and seals as well as to other structural components of the system.

Figure 5:
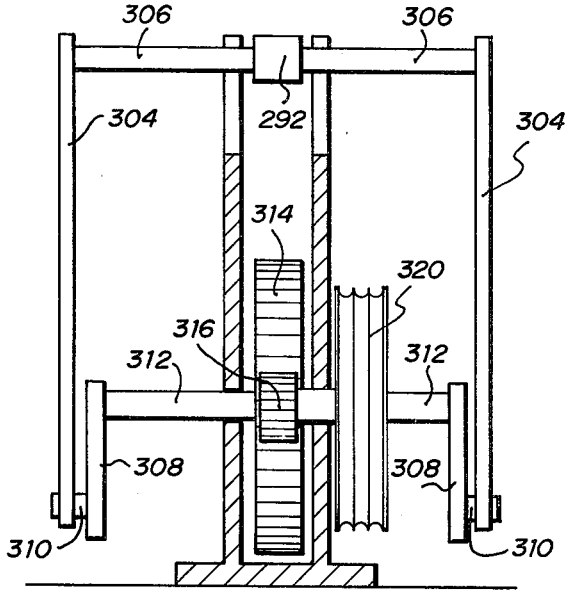
FIG. 5 is an end view of the drive system illustrated in FIG. 4.
Figure 4:
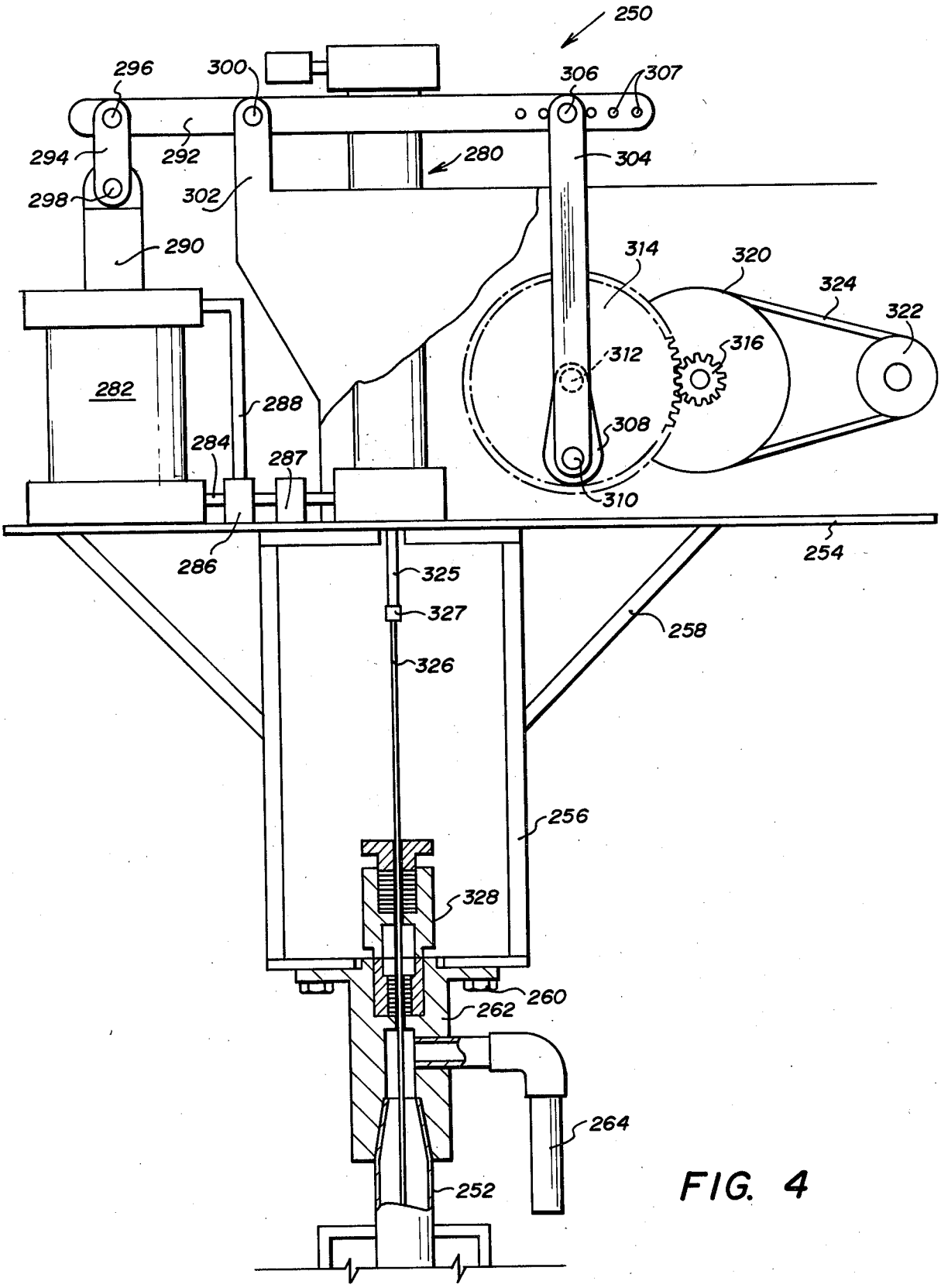
FIG. 4 is a vertical view of a second embodiment of the drive system of the present invention.

A second embodiment of the invention illustrated in FIGS. 4 through 7. Referring to FIGS. 4 and 5, a well pump drive system 250 is supported over and threadedly attached to the outer casing 252 of a deep well unit. The drive system 250 includes a platform 254 supported above a housing 256 by platform supports 258. Housing 256 is attached by appropriate fasteners 260 over a wellhead housing 262. Housing 262 is threadedly engaged onto the outer casing 252 of the well unit. Wellhead housing 262 includes a discharge pipe 264 through which oil or other fluid pumped from the well is discharged.

Platform 254 supports a lift cylinder unit 280 and a power pump unit 282. A conduit 284 connects power pump 282 and lift cylinder unit 280. A relief valve 286 is positioned intermediate of power pump unit 282 and lift cylinder unit 280 in conduit 284. A flow control valve 287 is positioned in conduit 284 between pressure relief valve 286 and the lift cylinder unit 280. A return line 288 is also provided from pressure relief valve 286 to the upper portion of power pump unit 282. A piston rod 290 has a portion extending upwardly from power pump unit 282 and is pivotally attached to one end of a rocker beam 292 by a connection beam 294 at pivot points 296 and 298. Rocker beam 292 is pivotally supported at pin 300 from rocker beam support 302. Support 302 is attached at its lower end to platform 254. The end of rocker beam 292 remote from piston 290 is pinned to drive beam 304 by pin 306 through one of the apertures 307 formed in the end of rocker beam 292. Through the selection of the particular aperture 307 to which drive beam 304 is pinned, the particular stroke of piston 290 can be adjusted as desired.

The end of drive beam 304 remote from rocker beam 292 is attached to and driven by a rotating lug 308 having a pin extension 310 engaging one end of drive beam 304. Lug 308 is rotated about a central shaft 312 which is concentric with a toothed gear 314 driven by a second gear 316. Gear 316 is concentric with belted pulley 320 which in turn is driven by prime mover 322 by way of belts 324.

A lift piston rod 325 extends downwardly from lift cylinder unit 280. A polish rod 326 is attached to the lower end of piston rod 325 by a coupling 327. Polish rod 326 passes through a stuffing box 328 and into the well casing 252 where the rod is connected to and actuates the well pump unit. Stuffing box 328 is threadedly engaged within wellhead housing 262 and includes sufficient sealing and packing components to provide a fluid tight seal between the wellhead housing and the polish rod.

Figure 6:
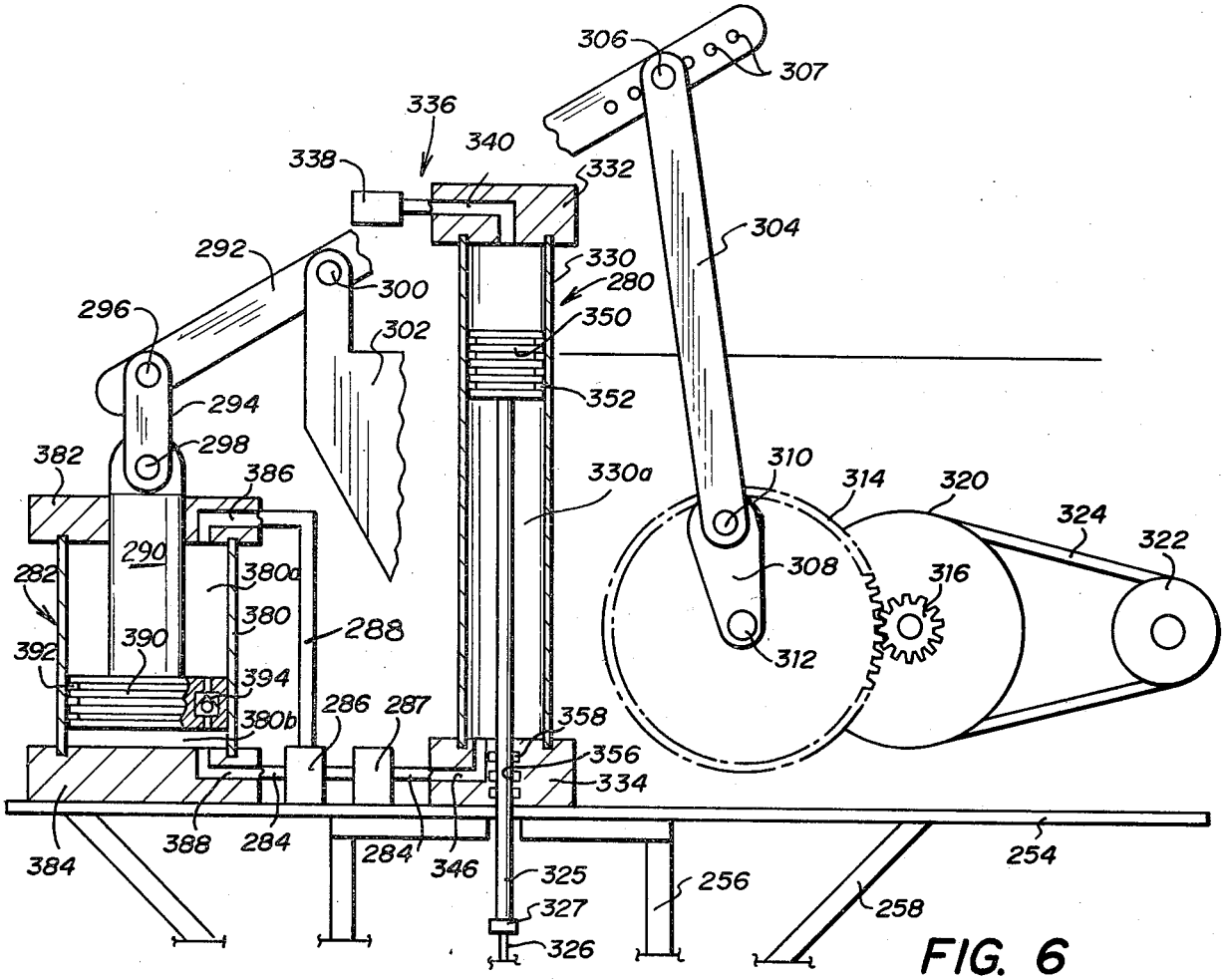
FIG. 6 is a partially diagrammatic vertical section view of the drive system illustrated in FIG. 4.
Figure 7:
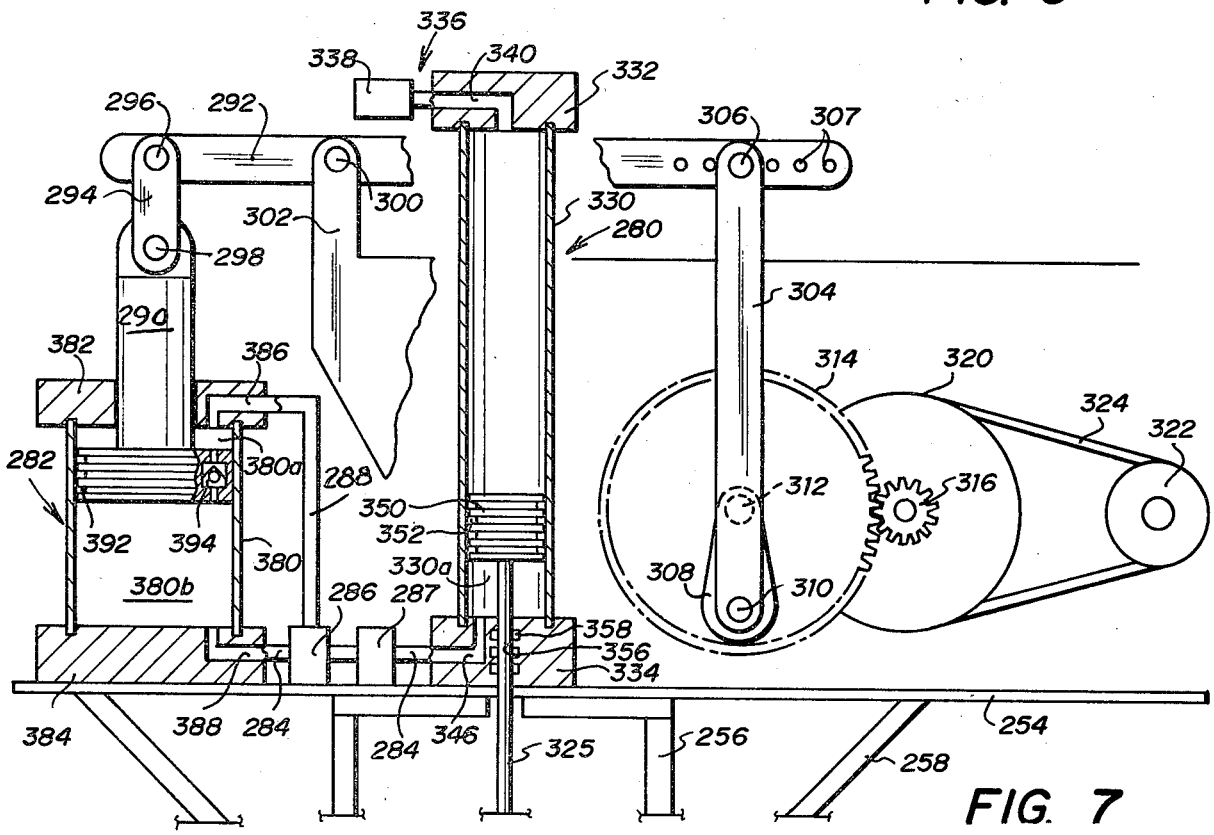
FIG. 7 shows the drive system as illustrated in FIG. 6, but with the lift piston near the lowermost point of its stroke.

Referring to FIGS. 6 and 7, vertical section views of the drive system 250 as illustrated. As can be seen in both FIGS. 6 and 7, lift cylinder unit 280 includes a cylinder 330 with an upper and lower manifold 332 and 334, respectfully, partially closing the ends thereof. Upper manifold 332 is fitted with a valve 336 including a filter 338 connected to an aperture 340 through manifold 332 and communicating between the interior of cylinder 330 and the outer atmosphere by way of filter 338. Lower manifold 334 is also provided with an aperture 346 communicating between the interior of cylinder 330 and conduit 284. A piston 350 is fitted for reciprocation within cylinder 330 and a plurality of sealing rings 352 are fitted around the circumference of piston 350 to form a fluid tight seal between the piston and the cylinder. Lift piston rod 325 is attached to the underside of piston 350 and passes through a bore 356 in manifold 334. A plurality of seals 358 are received within bore 356 and engage rod 325 to form a fluid tight seal therebetween. Polish rod 326 is attached to the lower end of rod 325 by an appropriate coupling 327. Polish rod 326 is connected to and operates the well pump unit in the usual fashion.

Referring still to FIGS. 6 and 7, power pump unit 282 includes a cylinder 380 with an upper manifold 382 and a lower manifold 384 partially closing off the ends of the cylinder. Upper manifold 382 includes a port 386 communicating between the interior of cylinder 380 and return line 288. Lower manifold 384 includes a similar port 388 which communicates between the interior of cylinder 380 and conduit 284. A piston 390 is attached to piston rod 290 for reciprocation within cylinder 380. A plurality of ring seals 392 are fitted around the circumference of piston 390 and operate to form a fluid tight seal between the piston and the cylinder walls. A check valve 394 is positioned in piston 390 and permits one way flow of fluid from the upper chamber **380*a* above piston 390 to the lower chamber 380*b* below piston 390** as will be discussed hereinafter in greater detail.

In operation of the system, prime mover 322 is operated to drive belt 324 and pulley 320. As belted pulley 320 rotates, toothed gear 316 attached thereto is also rotated and its engagement with toothed gear 314 causes the rotation of shaft 312. Lugs 308 attached to shaft 312 are in turn rotated and through their connection with pin extension 310 to drive beams 304, rocker beam 292 is moved in a rocking fashion about pivot pin 300 on rocker beam support 302 (FIG. 5). As the end of rocker beam 292 attached to drive beam 304 moves upwardly, its opposite end attached to piston 390 by way of connection beam 294 and piston rod 290 is forced downwardly.

A hydraulic fluid is loaded below piston 390 as well as below lift cylinder piston 350. This fluid is directed from lower chamber **380*b* below piston 390 and into chamber 330*a* below piston 350 by passage through conduit 284. As fluid is directed into chamber 330*a* below piston 350 of the lift cylinder, the piston rises thereby driving polish rod 360** attached therefrom.

By referring to FIGS. 6 and 7, it will be appreciated that the diameters of piston 390 and cylinder 380 of the power pump are substantially larger than corresponding diameters of the lift cylinder and its piston. Therefore, the piston 390 moves through relatively short strokes compared to the much longer strokes through which the lift cylinder piston operates.

It will be appreciated that as the end of rocker beam 292 connected to drive beam 304 begins to move downwardly under the action of lug 308, piston 390 of the power pump 282 is raised. Correspondingly, the lift cylinder piston 350 drops under the action of its own weight and fluid is forced from chamber **330*a* below piston 350 through conduit 284 and back into chamber 380*b* below piston 390 of the power pump 282. Thus, as rocker beam 292 oscillates in a rocking fashion and piston 390 moves upwardly and downwardly, lift cylinder piston 350 also moves in a cyclic fashion upwardly and downwardly to drive polish rod 326. In turn, the well pump is operated in response to the upward and downward movement of polish rod 326**.

The embodiment illustrated in FIGS. 4 through 7 also provides for the situation where the well pump is stalled in the downhole line. If for any reason, the lift cylinder piston 350 resists the upward movement generally provided by the present drive system, increased pressure in conduit 284 and its passage through pressure relief valve 286 causes the valve to open and permits the flow of fluid through return line 288 and manifold 382 into upper chamber **380*a* above piston 390. This fluid is permitted to pass by way of check valve 394 to its normal working position below piston 390 into chamber 380*b***. Thus, a buildup in pressure caused by stalling of the pump well will not result in damage to either the lift piston, its associated structure, or the power pump.

As discussed with respect to the embodiment illustrated in FIGS. 1 through 3, valve 336 attached to the upper manifold 332 of the lift cylinder permits the free flow of air into and out of the lift cylinder as necessitated by the oscillation of lift cylinder piston 350. Additionally, lift cylinder piston 350 is permitted to rise in response to the expansion of fluids therebelow without damage to the system because of the presence of valve 336.

Flow control valve 287 positioned between pressure relief valve 286 and lift cylinder 280 may also be controlled as desired to vary the flow rate of fluid and thus the rate of ascent and descent of piston 350. Thus, the rate of operation of the well pump may be controlled by the flow control valve 287.

Additionally, the stroke of the lift cylinder piston 350 may be controlled by the movement of the connection of drive beam 304 to rocker beam 292. By moving the connection toward pivot pin 300, the movement of the rocker beam end connected to piston 390 is increased while the movement of the connection of drive beam 304 to rocker beam 292 away from pivot pin 300 shortens the stroke of piston 390. As the stroke of piston 390 is altered, the stroke of lift cylinder piston 350 is likewise altered. In this way, control of the polish rod 326 can be varied according to the particular needs of each individual well.

Figure 8:
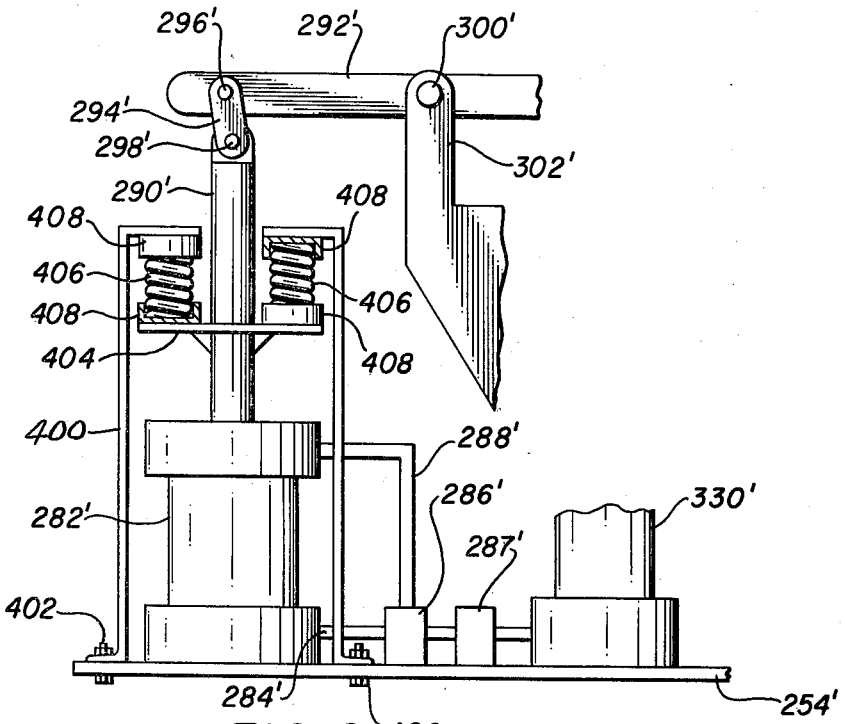
FIGS. 8 and 9 illustrate a third embodiment of the invention.
Figure 9:
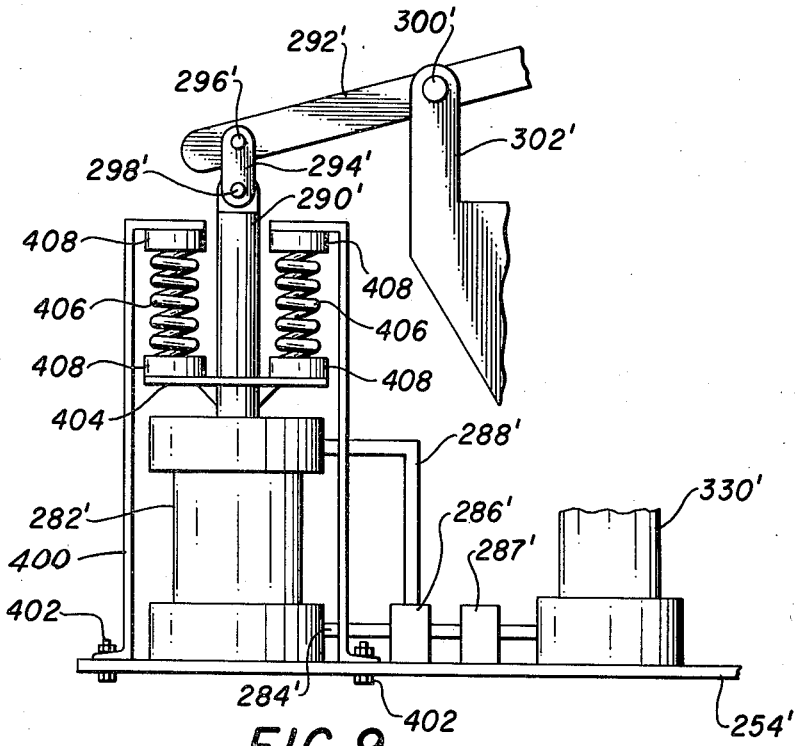

A third embodiment of the invention is illustrated in FIGS. 8 and 9. Various components parts of the third embodiment of the invention are substantially identical in construction and function to component parts of the second embodiment of the invention as illustrated in FIGS. 4 through 7. Such identical component parts are designated in FIGS. 8 and 9 by means of the same reference numerals utilized hereinabove in the description of the second embodiment of the invention, but are differentiated therefrom by means of a prime (') designation.

A subframe 400 is secured to the platform 254' by means of fasteners 402. This piston rod 290' is extended from power pump unit 282', and a flange 404 is secured to the piston rod 290' for movement therewith. The flange 404 may be secured to the piston rod 290' by conventional means, such as by welding or by means of appropriate fasteners.

A plurality of heavy coil springs 406 are mounted between the platform 404 and the upper end of the subframe 400 and are retained by spring cups 408. It will be appreciated that since the piston in the lift cylinder 330' moves downwardly under the action of gravity, the motor which actuates the rocker arm 292' is under essentially no load when the rocker arm 292' and the piston rod 290' are in the upstroke. The power of the motor is therefore used to compress the heavy coil springs 406 as the piston rod 290' moves upwardly. Subsequently, as the piston rod 290' moves downwardly the power thus stored in the heavy coil springs 406 is added to the power of the motor. By this means additional power is available to move the piston in the cylinder 330' upwardly. The down stroke of the piston rod 290' and the corresponding extension of the coil springs 406 is illustrated in FIG. 9.

Thus, the present invention discloses a drive system for operating a downhole well pump. The system provides for an extremely accurate control of the amount of force which is transmitted to the well pump through the polish rod and provides for appropriate valving which prevents the application of force exceeding a predetermined level. In this way, if for any reason the well pump is stalled, damage to any of the components in the system is prevented. Further, the present system eliminates stresses normally induced in the system as a result of expansion of fluids through changes in temperatures, resulting from weather changes or operation, by providing relief valving which is compatible with the operation of the overall unit.

The present systems also provide for accurate flow control so that the rate of operation of the drive unit may be varied as desired, as well as controls for varying the pump stroke as necessitated by the particular well pump being driven.

Although preferred embodiments of the invention have been described in the foregoing detailed description and illustrated in the accompanying drawings, it will be understood that the invention is not limited to the embodiments disclosed, but is capable of numerous rearrangements, modifications, and substitutions of parts and elements without departing from the spirit of the invention. The present invention is therefore intended to encompass such rearrangements, modifications, and substitutions of parts and elements as fall within the scope of the appended claims.

What is claimed is:

1. A drive system for driving the pump rod of a deep well pump, comprising:

a lift cylinder having a piston movable therein, said piston being connected to the pump rod of the well pump;

a motor having a piston slidable within a cylinder, the motor piston dividing the cylinder into a chamber above and below the piston, with one chamber of the cylinder in fluid communication with the chamber of the lift cylinder below the lift cylinder piston;

means for reciprocating said motor piston to direct fluid from said one chamber of said motor to said lift cylinder to raise said lift cylinder piston, thereby driving the pump rod of the well pump upwardly; and spring means mounted for compression under the action of the reciprocating means when said reciprocating means is actuated to move the motor cylinder piston in a direction to allow the lift cylinder piston to move downwardly in the lift cylinder, and for extension when the reciprocating means is actuated to move the motor cylinder piston to actuate the lift cylinder piston to move the pump rod of the well pump upwardly.

* * * * *